United States Patent [19]

White et al.

[11] Patent Number: 4,618,100

[45] Date of Patent: Oct. 21, 1986

[54] MULTIPLE PATTERN SPRAY NOZZLE

[75] Inventors: Glenn S. White, Canoga Park; Karl J. Mussler, Alta Loma; Gary A. Van Exel, Fullerton, all of Calif.

[73] Assignee: Rain Bird Consumer Products Mfg. Corp., Glendora, Calif.

[21] Appl. No.: 675,357

[22] Filed: Nov. 27, 1984

[51] Int. Cl.[4] ..... B05B 7/02; B05B 1/36

[52] U.S. Cl. ..... 239/440; 239/441; 239/447; 239/478; 239/482; 239/526

[58] Field of Search ..... 239/468–470, 239/526, 527, 441, 440, 447, 448, 480, 481, 449, 477, 478, 479

[56] References Cited

U.S. PATENT DOCUMENTS

| | | | |
|---|---|---|---|
| 334,800 | 1/1886 | O'Donnell | 239/481 |
| 1,034,101 | 7/1912 | Gibbs | 239/481 |
| 1,051,908 | 2/1913 | Normond | 239/477 X |
| 1,631,894 | 6/1927 | Schlaepfer | 239/481 |
| 1,704,498 | 3/1929 | Deming | 239/526 X |
| 2,127,188 | 8/1938 | Schillin et al. | 239/448 X |
| 2,333,767 | 11/1943 | Davis | 239/449 |
| 2,460,545 | 2/1949 | Sprang | 239/480 |
| 2,530,808 | 11/1950 | Cerasi | 239/441 X |
| 2,567,176 | 9/1951 | Ballard | 239/449 |
| 2,985,385 | 5/1961 | Bowers et al. | 239/456 |
| 3,111,273 | 5/1963 | Mei | 239/447 |
| 3,514,042 | 5/1970 | Freed | 239/448 X |
| 3,670,967 | 6/1972 | Fahlin et al. | 239/525 X |
| 4,117,979 | 10/1978 | Lagarelli et al. | 239/449 X |
| 4,221,337 | 9/1980 | Shames et al. | 239/447 X |
| 4,265,405 | 5/1981 | Takagi | 239/440 |

FOREIGN PATENT DOCUMENTS

| | | | |
|---|---|---|---|
| 742780 | 5/1943 | Fed. Rep. of Germany | 239/468 |
| 340560 | 5/1986 | Italy | 239/438 |
| 570403 | 9/1972 | U.S.S.R. | 239/468 |

OTHER PUBLICATIONS

Takagi Co. Ltd. advertising literature (3 pp.), illustrating Takagi Nozzle Five.

Takagi Co. Ltd. package card and instructions for Takagi Nozzle Five.

Sear Water Command package card.

Sherman Dial-A-Stream package card for No. 110C.

*Primary Examiner*—Joseph F. Peters, Jr.

*Assistant Examiner*—Kevin Patrick Weldon

*Attorney, Agent, or Firm*—Kelly, Bauersfeld & Lowry

[57] ABSTRACT

A multiple pattern spray nozzle is provided for connection to a supply of water under pressure, wherein the spray nozzle is adjustable upon movement of a single selector ring to one of several different spray pattern settings. The spray nozzle comprises a nozzle housing for mounting, for example, onto a hose end trigger valve or the like and supporting a stem unit for receiving the supply of water under pressure. A pair of flow control sleeves are carried by a perforate faceplate for sliding movement relative to the stem unit and nozzle housing to define different water flow paths leading respectively from the stem unit to different nozzle outlets formed by the faceplate in cooperation with the stem unit and nozzle housing. The selector ring in turn supports the faceplate and flow control sleeves and is threaded onto the nozzle housing for rotation thereabout to displace the flow control sleeves to select the water flow path and associated nozzle outlet open to water flow, thereby selecting the spray pattern setting. In the preferred form, the selector ring is rotatable to any one of five different setting positions to provide a discharged water stream in the form of a low flow mist, a conical spray, a narrow collimated jet spray, a gentle shower spray, or a generous low-force soaker flow.

36 Claims, 19 Drawing Figures

MULTIPLE PATTERN SPRAY NOZZLE

BACKGROUND OF THE INVENTION

This invention relates generally to spray nozzles of the adjustable type for controlled variation of the spray pattern characteristics of a discharged stream of water or the like. More specifically, this invention relates to an improved adjustable or multiple pattern spray nozzle particularly of the type for lawn and garden use, wherein the improved spray nozzle is adjustable quickly and easily and in a single motion to any one of several different spray pattern settings.

Adjustable pattern spray nozzles are widely known particularly for use in a lawn and garden environment to provide a discharged water stream which can be varied in flow rate and spray pattern geometry. Such spray nozzles are typically mounted at the discharge end of a conventional garden hose or the like. Alternately, adjustable pattern spray nozzles are frequently incorporated into or adapted for mounting onto the discharge end of a so-called trigger valve or trigger nozzle or the like which in turn receives a supply of water under pressure, for example, from a garden hose. The adjustable spray nozzle normally includes an externally accessible adjustment mechanism for varying the geometry of a nozzle outlet to control the spray pattern characteristics of a discharged water stream in accordance with the requirements of a particular task. For example, in some instances, a relatively gentle and relatively low-pressure shower or spray may be desired for irrigating delicate vegetation or for supplying irrigation water to a soil region without significant soil erosion. In other instances, a more forceful jetlike stream may be desired, for example, for rinsing or sweeping hard surfaces, such as patios and sidewalks, or for use in washing motor vehicles and the like.

In one common form, adjustable pattern spray nozzles have included a barrel-like nozzle body adapted for in-line connection with the discharge end of a garden hose or the like, wherein the downstream end of the nozzle body includes a contoured nozzle outlet of a truncated conical or other desired shape. An internal stem is mounted within the nozzle body in a manner permitting relative longitudinal displacement between the stem and the nozzle outlet to alter the open flow path geometry and thereby alter the spray pattern of a discharged water stream. Well known adjustment mechanisms for obtaining this relative stem displacement include, for example, outer adjustment sleeves rotatable about the nozzle body and spring-loaded trigger devices incorporated into pistol-type mechanisms. While adjustable spray nozzles of this general type advantageously permit substantially continuous spray pattern variation ranging between a relatively coarse mist and a narrow jet stream spray, these spray nozzles have generally been incapable of providing specialized spray pattern geometries required for some watering applications.

Alternative adjustable pattern spray nozzles have been developed to include a plurality of discrete nozzle outlets for providing different water spray pattern having selected geometric characteristics not otherwise available in continuously adjustable nozzles of the above-described type. In one typical form, such alternative adjustable spray nozzles have included a rotatable turret having a circular array of differently geometried nozzle outlets, wherein a selected one of these nozzle outlets can be rotated to an operational position at the downstream end of a water flow path to control the spray pattern geometry of a discharged water stream. The various nozzle outlets, however, occupy only small portions of the turret surface area thereby placing undesired size restrictions upon the spray pattern configurations, particularly such as low force fan or shower sprays. In addition, disassembly of the turret for occasional cleaning of small nozzle outlet openings of the type required to obtain a low force shower spray or the like can be a difficult procedure. Other multiple pattern spray nozzle designs have been proposed with multiple nozzle outlets disposed in concentric array, wherein two or more externally accessible adjustment rings are rotatable individually or in groups to select the nozzle outlet or outlets from which water is discharged. However, the requirement for multiple adjustment rings unduly complicates selection of a desired spray pattern geometry.

There exists, therefore, a significant need for an improved adjustable or multiple pattern spray nozzle having a plurality of nozzle outlets for providing different spray pattern geometries to a discharged water stream, wherein some of these nozzle outlets are distributed over substantially the entire discharge surface area of the spray nozzle, and wherein spray pattern selection is obtained quickly and easily by movement of a single adjustment mechanism. The present invention fulfills these needs and provides further related advantages.

SUMMARY OF THE INVENTION

In accordance with the invention, an improved multiple pattern spray nozzle is adjustable quickly and easily to a selected one of several different spray pattern settings to control the spray pattern geometry and forcefulness of a discharged stream of water or the like. The spray nozzle comprises a nozzle housing subassembly adapted for connection to a supply of water under pressure, such as by connection to the discharge end of a hose end trigger valve or the like. The nozzle housing subassembly rotatably supports a faceplate subassembly including an externally accessible selector ring for rotating the faceplate subassembly to a selected one of several different spray pattern setting positions. The nozzle housing and faceplate subassemblies cooperate to define a plurality of water flow paths leading respectively to a plurality of nozzle outlets of different spray pattern geometries, wherein the water flow path and associated nozzle outlet open to water flow is selected by appropriate positioning of the selector ring.

In a preferred form of the invention, the nozzle housing subassembly comprises a generally cylindrical nozzle housing having an upstream or rearward end of reduced diameter forming an inlet fitting for appropriate connection to the supply of water under pressure. A stem unit includes a generally cylindrical stem supported coaxially within the inlet fitting and having an open upstream end for receiving the water flow. A plurality of radially open flow ports are formed in the stem near an axially closed downstream or forward end thereof to permit radially outward water discharge. A swirl cap also forms a portion of the stem unit and includes a generally truncated conical base seated on the closed forward end of the stem and defining a plurality of inlet ports opening tangentially into a swirl chamber. Water flow into the swirl chamber is communicated in turn to the exterior of the spray nozzle through a relatively small bore mist nozzle outlet formed through a cylindrical forward discharge barrel of the swirl cap, wherein this discharge barrel includes a slightly enlarged deflector ring about the forward tip thereof.

The faceplate subassembly comprises the selector ring threadably mounted about the nozzle housing for rotational movement about a central axis of the nozzle housing and the stem unit. The axially forward or downstream end of the selector ring supports a generally circular faceplate having perforations therein defining multiple nozzle outlets, with said faceplate in the preferred form defining an annular outer pattern of relatively large soaker flow channels, an annular inner pattern of relatively small shower spray openings, and a central nozzle outlet having a conical shape generally concentric with the swirl cap and diverging toward the forward end of the spray nozzle.

The axially upstream or rearward end of the central nozzle outlet of the faceplate carries an inner flow control sleeve formed by a cylindrical bushing supported in concentric relation about a portion of the cylindrical stem and the swirl cap of the nozzle housing subassembly. The rear end of this bushing carries an annular cap ring which cooperates with the bushing to support a first seal ring in substantially sealed, axially sliding relation about the cylindrical stem. The axially forward end of the bushing includes a valve seat of reduced diameter for engaging the conical outer surface of the swirl cap base at a position downstream from the swirl chamber inlet ports. This valve seat merges in turn with a relatively short, generally cylindrical jet nozzle outlet which blends into the axially rearward end of the conical nozzle outlet of the faceplate.

An outer flow control sleeve is also supported by the faceplate in a position generally concentric with and spaced radially inwardly from the inner diameter surface of the nozzle housing. A second seal ring is carried by this outer flow control sleeve for substantially sealed, sliding engagement with the inner diameter surface of the nozzle housing, the axially forward end of which is defined by a radially enlarged flow recess interrupted by an annular array of circumferentially spaced axial support ribs.

Rotation of the selector ring correspondingly rotates the faceplate subassembly relative to the nozzle housing subassembly to control water flow to the various nozzle outlets. More particularly, the faceplate subassembly is rotatable to one axial end limit position with the bushing valve seat seated upon the swirl cap base. In this position, the first seal ring is disposed axially rearwardly from the stem flow ports to permit water flow through the stem flow ports and in a forward direction between the stem and inner flow control sleeve inwardly through the swirl cap inlet ports into the swirl chamber for subsequent discharge through the mist nozzle outlet as a relatively low flow mist spray pattern. The selector ring is rotatable to a conical spray pattern setting position with the bushing valve seat displaced axially in a forward or downstream direction from the swirl cap base to permit water flow discharge through the cylindrical jet nozzle outlet of the bushing. In this position, the deflector ring on the swirl cap is disposed sufficiently downstream relative to the bushing nozzle outlet to deflect the water flow radially outwardly along the conical nozzle outlet of the faceplate thereby providing a conical spray pattern. Further selector ring rotation draws the bushing jet nozzle outlet into close concentric surrounding relation with the swirl cap deflector ring to limit water discharge to a substantially collimated, substantially high-pressure jet spray. Additional rotation of the selector ring displaces the first seal ring on the inner flow control sleeve to a forward position relative to the stem flow ports thereby blocking water flow between the inner flow control sleeve and the stem. Instead, the water flow is directed radially outwardly into the annular space or chamber between the inner and outer flow control sleeves for discharge through the shower spray openings as a gentle shower spray pattern. Finally, further selector ring rotation displaces the second seal ring on the outer flow control sleeve into axial alignment with the enlarged flow recess at the forward end of the nozzle housing to permit a generous low-pressure soaker flow between the support ribs for discharge from the spray nozzle predominantly through the faceplate soaker channels. In this final spray pattern setting position, a retainer ring carried by the selector ring includes stop surfaces for flush engagement with threads on the nozzle housing to provide an opposite end limit to selector ring movement.

Other features and advantages of the present invention will become more apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
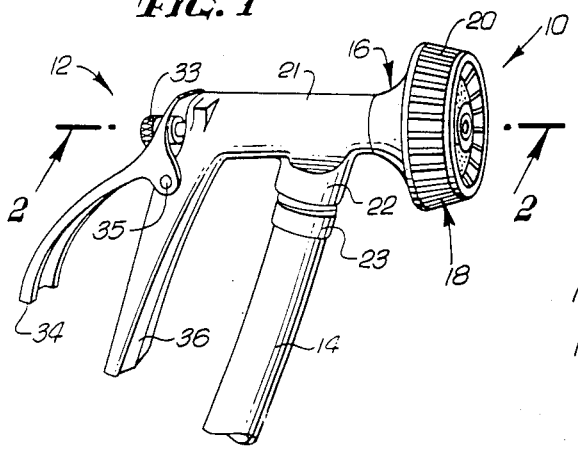
FIG. 1 is a perspective view illustrating a hose end trigger valve supporting a multiple pattern spray nozzle embodying the novel features of the invention.

As shown in the exemplary drawings, a multiple pattern spray nozzle referred to generally by the reference numeral 10 is provided for connection to a supply of water under pressure, such as by connection to a trigger valve 12 mounted on the discharge end of an ordinary garden hose 14 or the like, as viewed in FIG. 1. The multiple pattern spray nozzle 10 is adjustable quickly and easily and in a single motion to any one of several different spray pattern setting positions to provide a discharged water stream having selected spray pattern geometry and forcefulness.

The multiple pattern spray nozzle 10 of the present invention provides an improved and simplified adjustable pattern nozzle construction designed for rapid yet accurate selection of a desired water stream spray pattern in a single motion with a single adjustment mechanism. More particularly, the improved spray nozzle 10 includes a nozzle housing subassembly 16 adapted for connection to a supply of water under pressure and for movably supporting a faceplate subassembly 18 including an externally accessible selector ring 20. The faceplate subassembly 18 is rotatable as a unit relative to the nozzle housing subassembly 16 and cooperates therewith to define a plurality of water flow paths through the spray nozzle leading to a plurality of nozzle outlets of different spray pattern geometries, wherein at least some of these nozzle outlets are defined in turn by patterns of outlet openings distributed across a substantial portion of the discharge or forward end of the spray nozzle. Rotation of the selector ring 20 about the nozzle housing subassembly is effective to select the specific water flow path and associated nozzle outlet open to the water supply, thereby selecting the spray pattern geometry of the discharged water stream. The faceplate subassembly 18 is conveniently removable quickly and easily from the nozzle housing subassembly to permit cleaning of the nozzle outlets when required.

Figure 2:
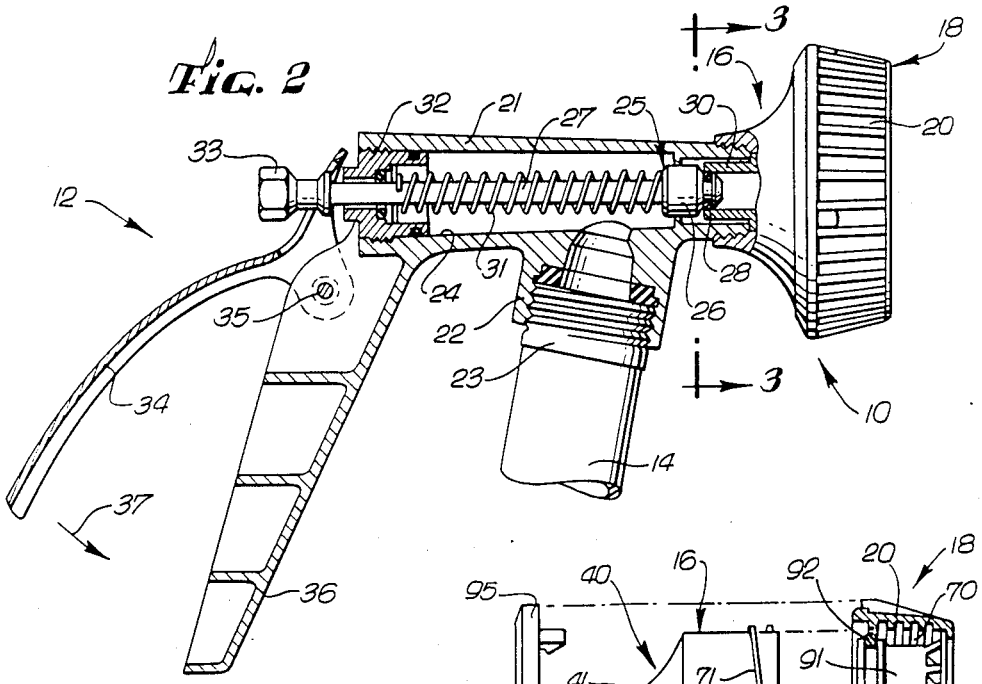
FIG. 2 is an enlarged fragmented vertical section taken generally on the line 2—2 of FIG. 1, with the spray nozzle being illustrated partially in side elevation.

In a preferred form, the multiple pattern spray nozzle 10 is adapted for mounting onto the discharge end of the hose end trigger valve 12 as shown in FIGS. 1 and 2. The illustrative trigger valve 12 includes an internal shut-off valve cooperating with the spray nozzle 10 to controllably connect and disconnect the spray nozzle to the water supply provided via the garden hose 14. Alternatively, the spray nozzle 10 can be adapted for direct connection to the discharge end of the garden hose 14 or for connection to valve mechanism and/or water supply conduits of different forms.

More particularly, the illustrative hose end trigger valve 12 comprises a hollow elongated barrel 21 including a downwardly open threaded hose fitting 22 for appropriate connection to a matingly threaded hose fitting 23 at the discharge end of the garden hose 14. Water under pressure is communicated from the hose 14 into the hollow interior 24 of the barrel 21 for controlled flow to the spray nozzle 10 in accordance with the position of a spring-loaded shut-off valve 25, as shown in FIG. 2. This valve 25 comprises an enlarged valve guide 26 on one end of an elongated valve stem 27 extending through the trigger valve barrel 21, wherein the valve guide 26 aligns an annular seal 28 for sealed engagement with the upstream or rear end of a cylindrical stem 30 of the spray nozzle 10, as will be described herein in more detail. Alternately, the valve guide 26 and seal 28 can be adapted for engagement with an appropriate valve seat (not shown) within the barrel 21. A compression spring 31 reacts between the valve guide 26 and a rear barrel end cap 32 to urge the valve guide 26 and seal 28 toward a normal closed position seated against the axially upstream end of the spray nozzle stem 30. A rear end of the valve stem 27 extends through the barrel end cap 32 and carries an enlarged actuator knob 33 which is shaped for retracting engagement with the upper end of a trigger lever 34 mounted by a pin 35 for pivoting motion with respect to an easily grasped trigger valve handle 36. Accordingly, the trigger lever 34 can be depressed manually toward the handle 36, in the direction of arrow 37 in FIG. 2, to retract the valve guide 26 and seal 28 from the spray nozzle stem 30 to permit water flow from the garden hose 14 into the spray nozzle 10. Release of the trigger lever 34, however, permits the compression spring 31 to return the valve guide and seal to the closed position seated against the stem 30 to prevent water flow into the spray nozzle 10.

As shown best in FIGS. 3, 4, 7, and 8, the nozzle housing subassembly 16 of the multiple pattern spray nozzle 10 includes a generally cylindrical nozzle housing 40 which can be molded or otherwise conveniently formed from a lightweight plastic material or the like. This nozzle housing 40 has a generally cylindrical shape to include a relatively small diameter upstream end defining an inlet fitting 41 for connection to the discharge or front end of the trigger valve barrel 21, with an internally threaded inlet fitting 41 being shown in the accompanying drawings for threaded connection onto the externally threaded front end of the barrel 21. If desired, this connection to the trigger valve 12 can be rendered permanent by use of an appropriate adhesive substance, or other types of interconnecting structures can be used. From the inlet fitting 41, the nozzle housing 40 includes a radially expanding intermediate section 42 reinforced by internal ribs 43 and merging in turn with a larger downstream cylindrical section 44 to define an enlarged water flow chamber 45 (FIG. 7) open in an axially downstream or forward direction. This flow chamber 45 is radially bounded by an axially elongated cylindrical inner diameter surface 46 disposed generally concentrically about a central axis 47 of the inlet fitting 41. This inner diameter surface 46 merges at the forward end of the nozzle housing cylindrical section 44 with a further radially enlarged flow recess 48 interrupted by a circumferentially spaced array of relatively short axial support ribs 49.

The nozzle housing subassembly 16 further includes a stem unit 50 which is also formed preferably from lightweight plastic molded components or the like and is preassembled with the nozzle housing 40 before the faceplate subassembly 18 is mounted thereon. This stem unit 50, as shown in FIGS. 7, 8, and 11–13 comprises the hollow cylindrical stem 30 which includes an enlarged external flange 51 for seating against the upstream axial side of an annular shoulder 52 forming a portion of the inlet fitting 41 to orient an open upstream end 53 of the stem 30 in operative relation with the valve guide 26 and seal 28 of the trigger valve 12. The flange 51 is desirably secured to the shoulder 52 as by a sonic weld or by other suitable connection means. A downstream end portion of the cylindrical stem 30 protrudes from the shoulder 52 concentrically about the central axis 47 into the housing flow chamber 45 and terminates in an axially closed downstream or forward end wall 54. A circular array of radially open flow ports 55 are formed in the stem 30 near this front end wall 54 to permit water flow radially outwardly from the stem interior 56 for guided passage to a selected one of the spray nozzle outlets, as will be described.

A hollow swirl cap 60 forms a portion of the stem unit 50 and further defines one nozzle outlet of the spray nozzle 10. This swirl cap comprises, in the exemplary form of the invention, a base 61 of generally truncated conical shape diverging toward an upstream end shaped for seated connection onto the forward end wall 54 of the stem 30, as by means of sonic welds or other appropriate fastening means. An annular array of angularly set inlet ports 62 are formed in the cap base 61 to permit water flow radially inwardly and generally tangentially into a small swirl chamber 63. This swirl chamber 63 communicates in turn with a relatively small bore mist nozzle outlet 64 which extends along the central axis 47 and opens to the exterior of the spray nozzle through a cylindrical forward discharge barrel 65 of the swirl cap 60. The forwardmost tip geometry of this mist nozzle outlet conveniently includes a short expansion section 66 (FIG. 11) disposed within a small but radially enlarged deflector ring 67.

Figure 4:
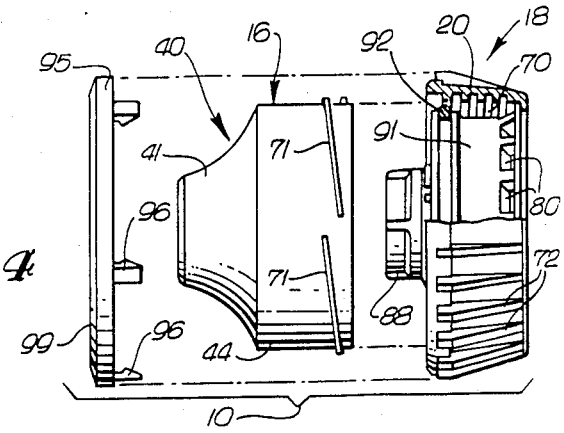
FIG. 4 is an exploded side elevation view, shown partly in vertical section, illustrating assembly of components forming the spray nozzle.
Figure 5:
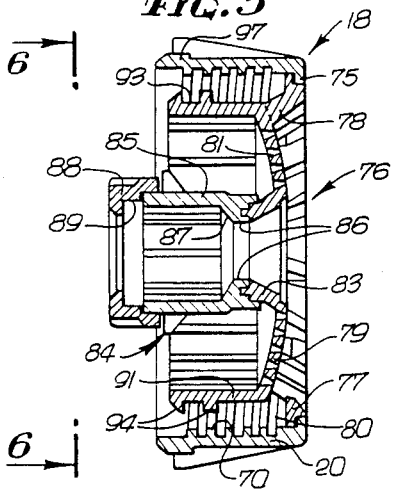
FIG. 5 is a vertical sectional view of a faceplate subassembly forming a portion of the multiple pattern spray nozzle.
Figure 6:
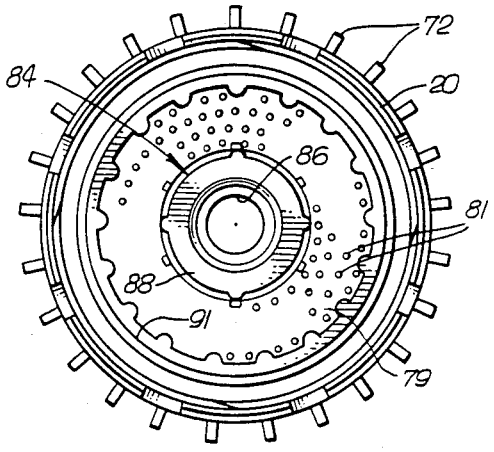
FIG. 6 is an upstream or rear end elevation view of the faceplate subassembly, taken generally on the line 6—6 of FIG. 5.
Figure 7:
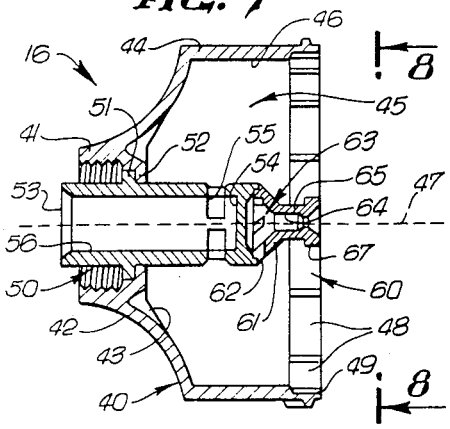
FIG. 7 is a vertical sectional view of a nozzle housing subassembly forming a portion of the multiple pattern spray nozzle.
Figure 8:
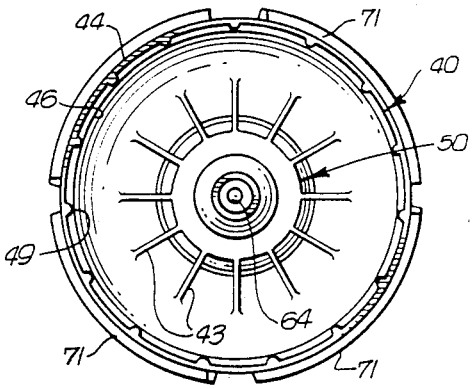
FIG. 8 is a downstream or front end elevation view of the nozzle housing subassembly, taken generally on the line 8—8 of FIG. 7.
Figure 9:
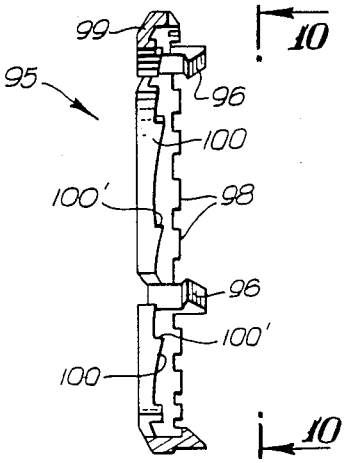
FIG. 9 is a vertical sectional view of a retainer ring forming a portion of the multiple pattern spray nozzle.
Figure 10:
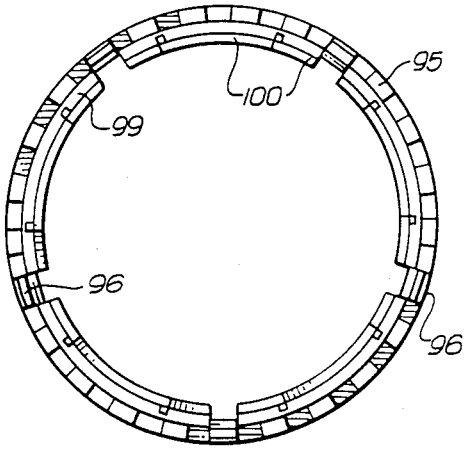
FIG. 10 is an downstream or front end elevation view of the retaining ring, taken generally on the line 10—10 of FIG. 9.

The faceplate subassembly 18 is also formed from a plurality of preassembled components formed conveniently from lightweight molded plastic or the like and cooperates with the nozzle housing subassembly 16 to define the various water flow paths and the remaining nozzle outlets. The selector ring 20 constitutes an integral component of the faceplate subassembly 18 and comprises a generally cylindrical ring having a size and shape for threaded mounting about the enlarged downstream section 44 end of the nozzle housing 40. In the preferred form, this threaded connection is achieved by forming a multi-lead female thread 70 on the inner diameter surface of the selector ring 20 (FIGS. 4–6 and 11) for threaded engagement with a plurality of upstanding part-circle male thread segments 71 formed on the nozzle housing generally in the vicinity of the enlarged forward end flow recess 48 (FIGS. 4 and 8). The number of these male thread segments 71 is chosen to correspond with the multi-lead female thread 70 on the selector ring 20, with four of said thread segments 71 being shown by way of example in FIG. 8. This multii-lead thread connection between the selector ring and the nozzle housing advantageously supports the selector ring 20 for relatively smooth rotation about the nozzle central axis 47 without significant tipping or cocking which might otherwise occur at or near the axial end limits of threaded engagement therebetween. Radially enlarged ribs 72 are conveniently formed about the exterior of the selector ring 20 to insure easy manual grasping thereof for rotation about the nozzle housing 40, as will be described.

Figure 16:
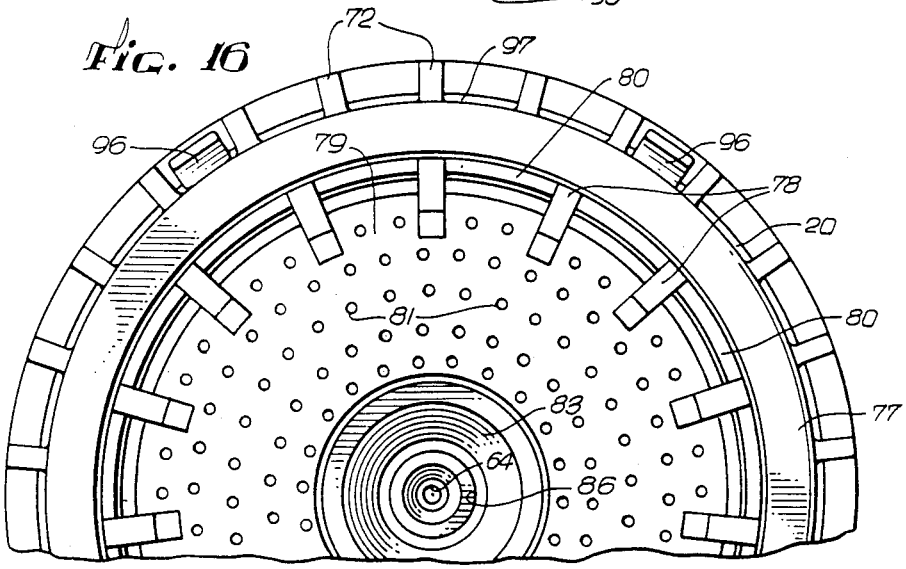
FIG. 16 is a fragmented downstream end elevation view taken generally on the line 16—16 of FIG. 15.

The axially downstream or forward end of the selector ring 20 includes a short radially inwardly directed annular rim 75 sized to slightly overhang the downstream end of the nozzle housing 40 when the selector ring is installed thereon. This rim 75 is connected to a faceplate 76 of molded plastic or the like to include an outer mounting ring 77 connected to the rim 75 by sonic welding or other suitable fastening means. The mounting ring 77 is joined to an annular arranged plurality of radially inwardly directed support arms 78 (FIGS. 4–6 and 16) which merge at their radially inner ends with the periphery of an annular faceplate wall 79. The mounting ring 77 thus cooperates with the support arms 78 and the periphery of the faceplate wall 79 to define an annular outer pattern of relatively large soaker channels 80 forming one of the nozzle outlets for the spray nozzle, as viewed best in FIG. 16.

The faceplate wall 79 has a slightly convex curvature presented in a forward or downstream direction and overlies a substantial portion of the total frontal surface area of the spray nozzle 10. This faceplate wall 79 is interrupted by a large plurality of shower spray openings 81 forming another nozzle outlet for the spray nozzle and having a size less than that of the soaker channels 80. These shower spray openings 81 are oriented individually on axes perpendicular to a line tangent to the curved faceplate wall at the individual locations of said openings, whereby the shower spray openings 81 permit passage of water flow as individual small streams distributed across a major portion of the spray nozzle surface area and diverging relative to one another to provide a shower spray pattern of substantial cross-sectional size and shape. For ease of molding, the individual shower spray openings 80 are conveniently formed to converge in a downstream direction.

The faceplate wall 79 is joined at its radially inner periphery to a central nozzle outlet 83 having a generally truncated conical shape diverging in a downstream or forward direction. The axially rearward end of this conical nozzle outlet 83 is shaped to form a seat for a first or inner flow control sleeve which protrudes in an axially rearward direction concentrically about the stem unit 50 when the faceplate subassembly 18 is installed upon the nozzle housing subassembly 16. This inner flow control sleeve 84, in one preferred form, comprises a generally cylindrical bushing 85 having an axially forward end shaped for secure attachment to the conical nozzle outlet 83, by sonic welding or the like. From this point of attachment, the bushing 85 extends rearwardly to define a short cylindrical jet nozzle outlet 86 which blends smoothly between the conical outlet 83 and a valve seat 87 of a generally truncated conical shape expanding in an axially rearward direction. This valve seat 87 is sized for substantially sealed abutting engagement with an exterior surface portion of the swirl cap conical base 61 at a position spaced forwardly from the inlet ports 62 and expands further therefrom to a generally cylindrical inner diameter surface sized for spaced relation relative to the cylindrical stem 30. An annular cap ring 88 is secured by sonic welding or the like onto the rear end of the bushing 85 and cooperates therewith to define a radially inwardly open groove 89 within which a first seal ring 90 (FIG. 11) is retained and supported.

The faceplate 76 further includes a second or outer control sleeve 91 having a generally cylindrical shape extending in a rearward direction from the periphery of the faceplate wall 79. This outer control sleeve 90 is formed generally concentric with the inner control sleeve 84 but with a larger diametric size for slight spaced relation from the inner diameter surface 46 of the nozzle housing 40. A second seal ring 92 (FIG. 11) is supported and retained about this outer control sleeve 91 generally at the rearward end thereof within a groove 93 defined by an axially spaced pair of short annular ribs 94.

Figure 11:
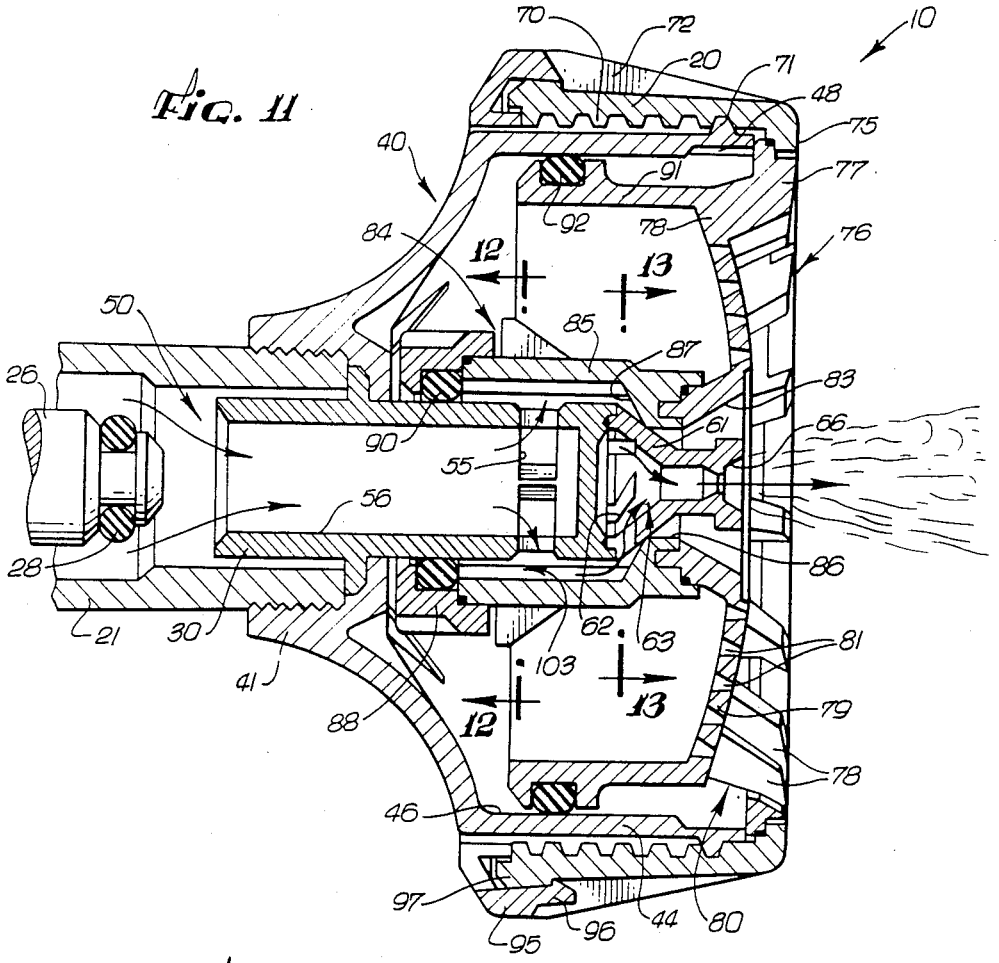
FIG. 11 is an enlarged fragmented vertical sectional view illustrating the multiple pattern spray nozzle in a mist spray pattern setting position.
Figure 12:
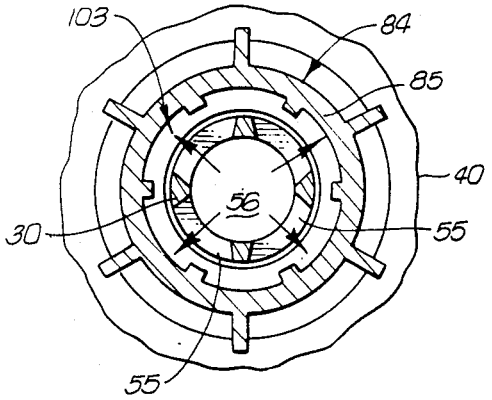
FIG. 12 is a fragmented vertical section taken generally on the line 12—12 of FIG. 11.
Figure 13:
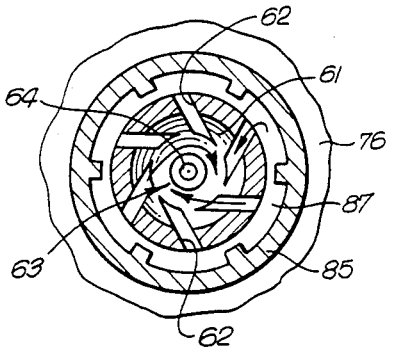
FIG. 13 is a fragmented vertical section taken generally on the line 13—13 of FIG. 11.

The thus-described faceplate subassembly can be installed quickly and easily onto the previously described nozzle housing subassembly 16 by threading the selector ring 20 rearwardly or in an upstream direction onto the nozzle housing 40, as shown best in FIGS. 4 and 11. When this occurs, the inner control sleeve 84 defined by the bushing 85 and the cap ring 88 is positioned concentrically about the cylindrical stem 30 with the first seal ring 90 in substantially sealed sliding engagement with the exterior surface of said stem 30. At the same time, the outer flow control sleeve 91 is placed concentrically within the nozzle housing 40 with the second seal ring 92 in substantial sealed, sliding relation with the inner diameter surface 46 of the housing. These flow control sleeves 84 and 91, and the seal rings 90 and 92 respectively carried thereby, alter the geometry of a water flow path through the spray nozzle 10 upon rotation of the selector ring 20 about the nozzle housing 40 to correspondingly switch the particular nozzle outlet through which water is discharged from the spray nozzle.

When the faceplate subassembly 18 is threaded onto the nozzle housing subassembly 16, a retainer ring 95 is quickly and easily engageable with the axially upstream or rearward end of the selector ring 20 to retain the faceplate subassembly in place. This retainer ring 95, as viewed in FIGS. 3, 4, 9, and 10, is formed preferably from plastic or the like and includes a circumferentially arranged plurality of axially forwardly extending latch teeth 96 for snap-fit engagement with raised seats 97 formed about the periphery of the selector ring between the enlarged ribs 72. Additional support fingers 98 may also be provided for fitting between remaining pairs of the ribs 72 help resist torque loads applied to the selector ring without significant risk of breakage of the latch teeth. An annular retainer wall 99 extends radially inwardly from the latch teeth 96 and terminates in a forwardly presented annular lip 100 shaped to define an array of stop surfaces 100' disposed at circumferential positions for engaging two or more of the part-circle male thread segments 71 on the nozzle housing 40 to prevent inadvertent removal of the faceplate subassembly when the retainer ring is in place. Importantly, these stop surfaces 100' are oriented generally perpendicularly to the direction of travel relative to the thread segments 71 to provide substantially flush positive stopping contact with the ends of said thread segments 71 without wedging of the retainer ring relative to the selector ring 20.

When assembled, the faceplate subassembly 18 can be placed in a mist spray pattern setting position by rotation of the selector ring 20 fully onto the nozzle housing 40 to displace the valve seat 87 within the bushing 85 into seated engagement with the swirl cap base 61, as shown in FIG. 11. This position is conveniently indicated by indicia 101 which can be molded into or otherwise carried by the retainer ring 95. For example, as viewed in FIG. 3, the indicia 101 can be formed on the annular retainer wall 99 and conveniently set apart in a highly visible fashion by circumferentially spaced notches 102. The mist spray pattern setting position is obtained by rotation of the selector ring 20 to a position with the term "mist" on the retainer ring 95 aligned above the barrel 21 of the trigger valve 12.

In the mist setting position, as shown in FIG. 11, water flow into the cylindrical stem 30 when the trigger valve is open is permitted to pass radially outwardly through the stem flow ports 55 into an annular flow chamber 103 between the bushing 85 and the stem 30. The first seal ring 90 is disposed rearwardly from these flow ports 55 and the valve seat 87 is seated against the swirl cap base 61, thereby limiting water flow to entry through the inlet ports 62 into the swirl chamber 63. The tangential nature of water flow entry into the swirl chamber 63 creates a substantial swirling action flow discharged outwardly through the mist nozzle outlet 64 as a relatively low flow, substantially mist or fog spray pattern.

Figure 3:
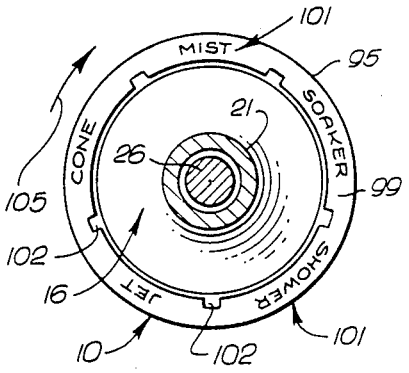
FIG. 3 is an upstream or rear end elevation view of the spray nozzle taken generally on the line 3—3 of FIG. 2.

The spray nozzle 10 can be adjusted quickly and easily to a conical spray pattern setting position by rotating the selector ring 20 in the direction of arrow 105, as viewed in FIG. 3, to align the term "cone" on the retainer ring 95 in the uppermost position relative to the trigger valve barrel 21. Such rotation simultaneously rotates the entire faceplate subassembly 18 as a unit and further translates the subassembly 18 a short distance along the nozzle housing 40 to retract the valve seat 87 of the bushing 85 in a forward direction from the swirl cap base 61, as shown in solid lines in FIG. 14. As a result, an annular flow path is opened between the swirl cap discharge barrel 65 and the cylindrical jet nozzle outlet 86 at the forward end of the bushing 85, while maintaining the deflector ring 67 on the discharge barrel 65 in a somewhat rearward position relative to the jet outlet 86. With this geometry, water flow is permitted to pass from the stem flow ports 85 between the swirl cap 60 and the bushing 85 where it is deflected by the deflector ring 67 radially outwardly to the conical outlet 83 to which it adheres for outward discharge in a generally conical spray pattern.

Figure 14:
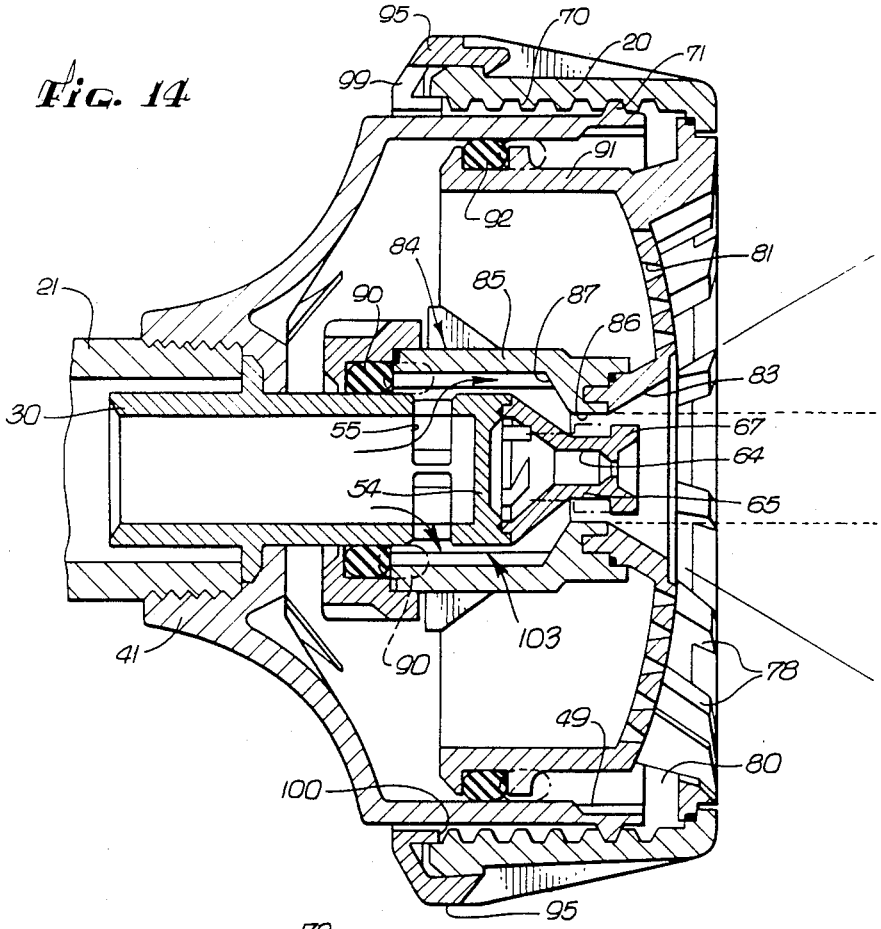
FIG. 14 is a fragmented vertical sectional view similar to FIG. 11 but illustrating the spray nozzle in a conical spray pattern setting position in solid lines and a narrow jet spray pattern setting position in dotted lines.

Further rotation of the selector ring 20 to the setting position designated by the term "jet" on the retainer ring 95 (FIG. 3) displaces the jet nozzle outlet 86 of the bushing 85 into close concentric surrounding relation with the swirl cap deflector ring 67, as viewed in dotted lines in FIG. 14. In this position, the first seal ring 90 remains at a slightly rearward position relative to the stem flow ports 55 whereby the water is permitted to flow through the narrow annular space between the jet outlet 86 and the swirl cap deflector ring 67. The thus-discharged water stream is therefore limited to a relatively low or narrow profile, substantially collimated jet stream spray pattern, as depicted in dotted lines in FIG. 14.

Figure 15:
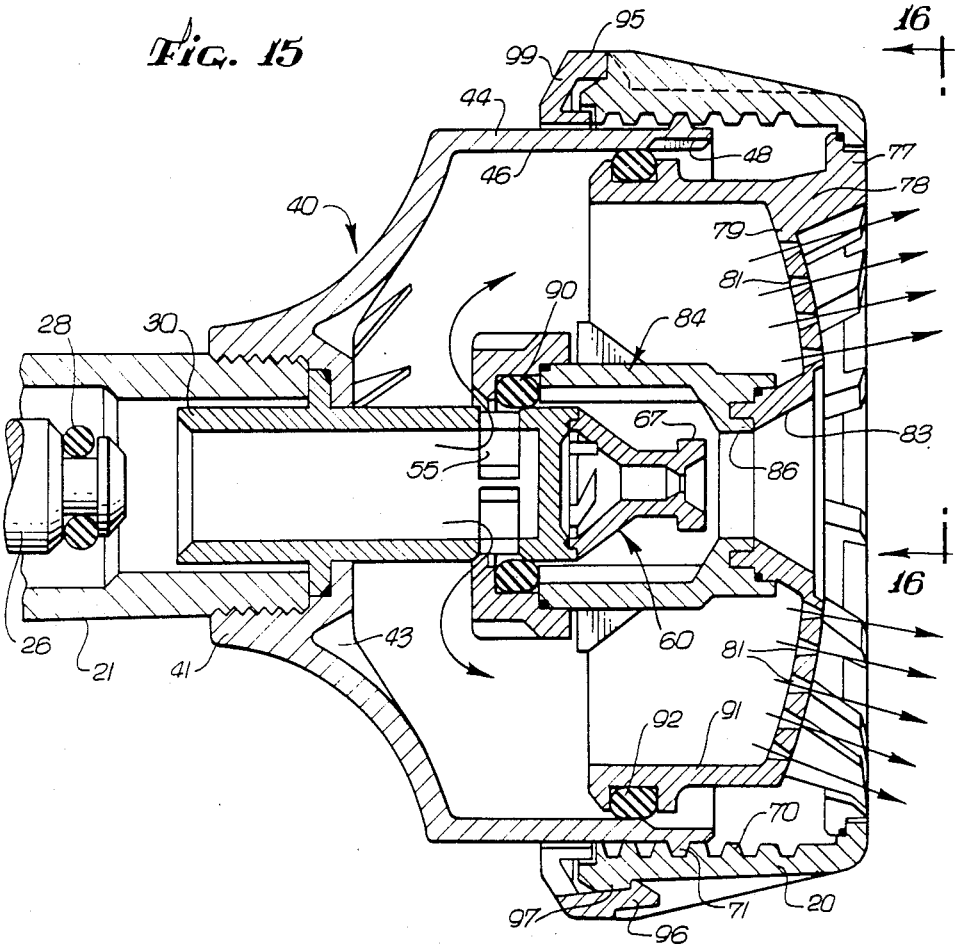
FIG. 15 is a fragmented vertical sectional view similar to FIG. 11 but illustrating the spray nozzle in a shower spray pattern setting position.

A fourth spray pattern setting position is obtained by further rotation of the selector ring 20 to align the term "shower" on the retainer ring (FIG. 3) in the upper position with respect to the trigger valve barrel 21. This spray pattern setting position, as viewed in FIG. 15, translates the first seal ring 90 on the inner flow control sleeve 84 to a forward position relative to the stem flow ports 55 thereby blocking further water flow through the bushing 85. Instead, water passing into the stem 30 is guided through the flow ports 55 radially outwardly into the nozzle housing 40 for open discharge passage through the large plurality of shower spray openings 81 as a relatively low force, diverging shower spray pattern.

Figure 18:
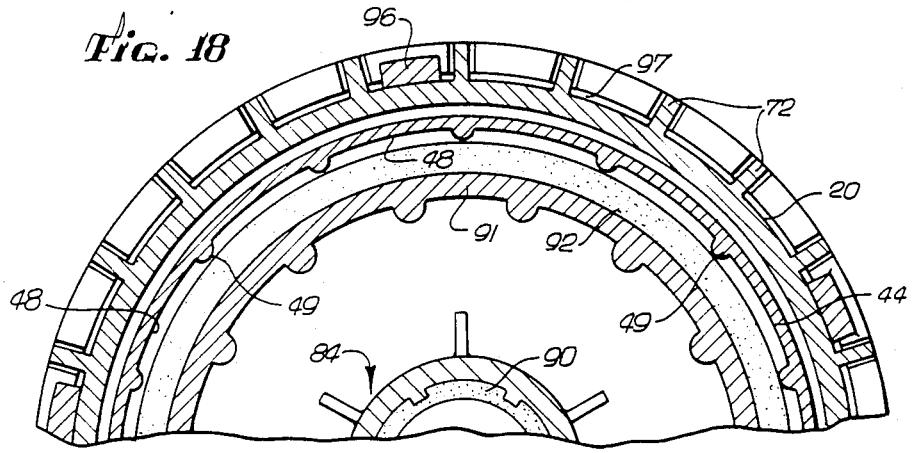
FIG. 18 is a fragmented vertical sectional view taken generally on the line 18—18 of FIG. 17.
Figure 17:
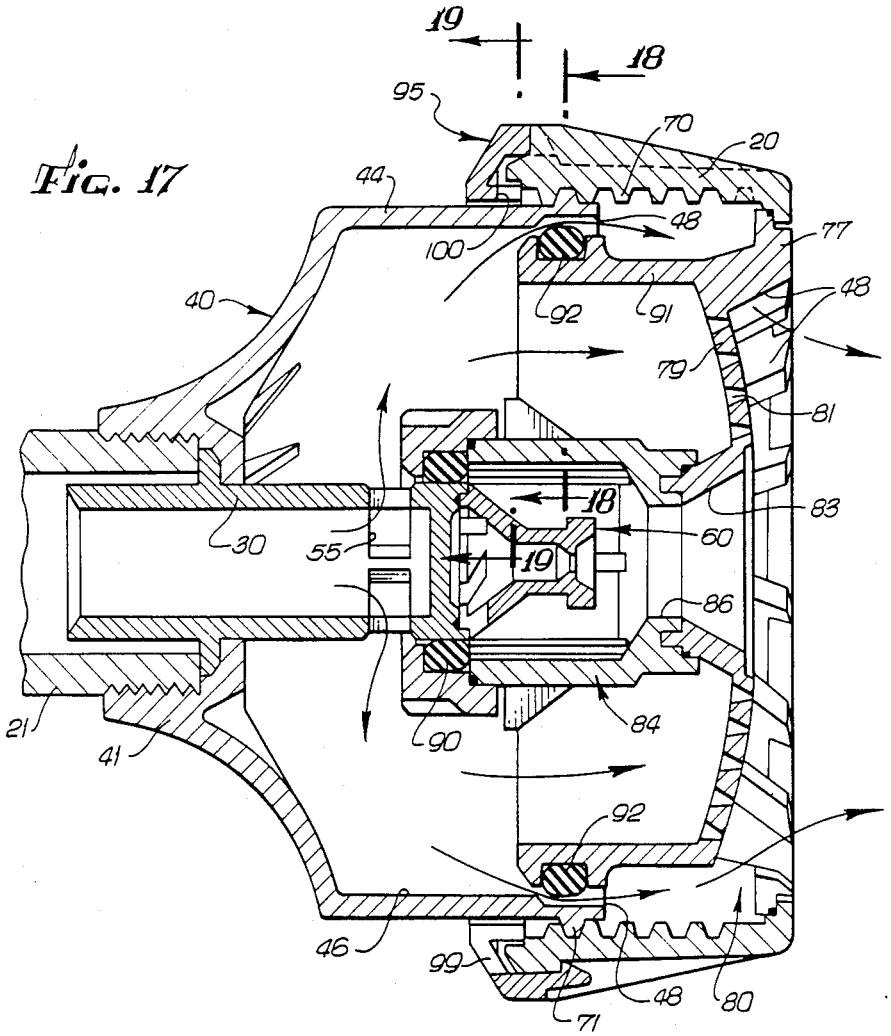
FIG. 17 is a fragmented vertical sectional view similar to FIG. 11 but illustrating the spray nozzle in a soaker flow spray pattern setting position.
Figure 19:
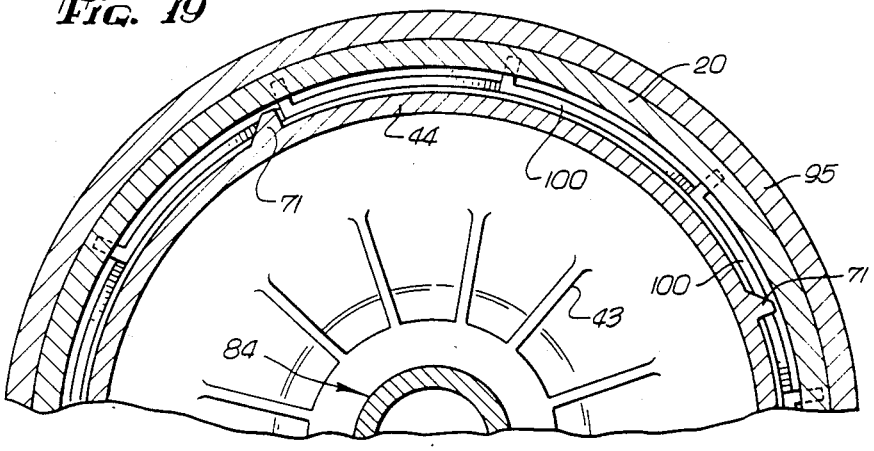
FIG. 19 is a fragmented vertical sectional view taken generally on the line 19—19 of FIG. 17.

In the preferred embodiment, a fifth and final spray pattern setting position is obtained by appropriately rotating the selector ring 20 to align the term "soaker" in the upper position relative to the trigger valve barrel 21. This spray pattern setting is illustrated in FIGS. 17–19 wherein the second seal ring 92 on the outer flow control sleeve 91 is displaced forwardly to an axial position aligned with the enlarged flow recess 48 in the nozzle housing and supported radially within the support ribs 49. When this alignment is achieved, additional water flow paths are opened between the support ribs 49 within the flow recess 48 wherein these support ribs 49 retain the seal ring against closure of the flow recess 48. Water passing through this flow recess is permitted to flow freely in a downstream or forward direction predominantly through the relatively large open soaker channels 80 to provide a generous but substantially low-force soaker water flow discharge from the spray nozzle.

Any of the above-described spray pattern setting positions can be obtained quickly and easily by simple rotation of the selector ring 20 about the nozzle housing 40. Such rotation displaces the pair of seal rings 90 and 92 relative to the stem 30 and the nozzle housing 40 for varying the open water flow path geometry within the spray nozzle and thereby also varying the particular nozzle outlet communicated with the supply of water under pressure. Importantly, for the shower and soaker spray pattern setting positions, water is discharged with a diametric spray size generally the same as the diametric size of the spray nozzle to provide water spray patterns of relatively large cross-sectional sizes. Moreover, the retainer ring 95 can be disengaged quickly and easily from the selector ring 20 whenever desired by simple release of the latch teeth 95 to permit removal of the faceplate subassembly for easy cleaning of the various nozzle outlets, if and when required.

A variety of modifications and improvements to the multiple pattern spray nozzle described herein will be apparent to those of ordinary skill in the art. Accordingly, no limitation on the invention is intended by way of the description herein, except as set forth in the appended claims.

What is claimed is:

1. A multiple pattern spray nozzle for connection to a supply of water under pressure and adjustable to provide a plurality of different spray patterns, said spray nozzle comprising:

a generally hollow nozzle housing having a rearward end for receiving a flow of water, and generally open forward end, and an internal seal surface bounded on the forward end thereof by a recessed flow channel;

a stem unit within said nozzle housing including an elongated hollow stem having an open rearward end for receiving the water flow into said nozzle housing and at least one flow port for passage of water flow from said stem;

a preferate faceplate supported on said nozzle housing generally over the forward end thereof and having first and second nozzle outlets of different geometry formed therein;

an inner flow control member extending from said faceplate into said nozzle housing in a generally rearward direction in surrounding relation with said stem and cooperating therewith to define a first flow path therebetween and further cooperating with said nozzle housing to define a second flow path therebetween, said inner flow control member being in generally surrounding relation with said first nozzle outlet;

an inner seal means acting between said inner flow control member and said stem for coupling said stem flow port to said first water flow path for water discharge through said first nozzle outlet when said inner seal means is in a first position rearward relative to said stem flow port and for coupling said stem flow port to said second flow path for water discharge through said second nozzle outlet when said inner seal means is in a second position forward relative to said stem flow ports;

an outer flow control member extending from said face place into said nozzle housing in spaced relation therewith and in surrounding relation with said first and second nozzle outlets, said faceplate having a third nozzle outlet formed therein outside said outer flow control member, and outer seal means for sealing engagement between said outer flow control member and said nozzle housing seal surface when said inner seal means is in the first and second position; and means for shifting said inner seal means between said first and second positions and for shifting said outer seal means to a forward position relative to said nozzle housing seal surface while said inner seal means is positioned forward relative to said stem flow port to permit water flow through said recessed flow chamber for discharge through said third nozzle outlet.

2. A multiple spray nozzle of claim 1 wherein said stem unit is connected to said nozzle housing to form a nozzle housing subassembly, and wherein said inner and outer flow control members, said inner and outer seal means, and said shifting means care carried by said faceplate to form a faceplate subassembly movable as a unit upon shifting movement of said inner seal means between the first and second positions.

3. The multiple pattern spray nozzle of claim 1 wherein said second nozzle outlet has a generally truncated conical shape diverging in a forward direction.

4. The multiple pattern spray nozzle of claim 1 wherein said first nozzle outlet has a generally cylindrical shape merging in a forward direction with a truncated conical portion which diverges in the forward direction, and said selector means including means for adjusting said first nozzle outlet along a rearward-forward direction to variably adjust the spray pattern geometry of water discharged through said first nozzle outlet.

5. The multiple pattern spray nozzle of claim 1 wherein said third nozzle outlet comprises a first annular array of relatively small outlet openings.

6. The multiple pattern spray nozzle of claim 5 wherein said third nozzle outlet comprises a second annular array of relatively small outlet openings having a geometry sized larger than the outlet openings of said second nozzle outlet.

7. A multiple pattern spray nozzle for connection to a supply of water under pressure and adjustable to provide a plurality of different spray patterns, said spray nozzle comprising:

a nozzle housing subassembly including a generally cylindrical nozzle housing having a rearward end defining an inlet fitting for connection to the water supply and a generally open forward end, and a stem unit within said nozzle housing and having a generally cylindrical stem with an open rearward end for receiving water flow through said inlet fitting, said stem further having a substantially closed forward end disposed in spaced relation with said nozzle housing and having at least one radially open flow port formed therein at a position generally adjacent said forward end; and a faceplate subassembly including a selector ring supported on said nozzle housing in an externally accessible position and axially movable relative to said nozzle housing, a faceplate carried by said selector ring in a position extending generally across the forward end of said nozzle housing, said faceplate having first and second nozzle outlets of different geometry formed therein, an inner flow control sleeve carried by said faceplate in surrounding relation with said first nozzle outlet and extending from said faceplate in surrounding relation with a forweard end portion of said stem, inner seal means carried by said inner flow control sleeve for axially sliding, substantially sealed engagement with said stem, and an outer flow control sleeve carried by said faceplate in surrounding relation with said first and second nozzle outlets and extending from said faceplate into said nozzle housing in spaced relation therewith, said nozzle housing further including a generally cylindrical seal surface and a radially enlarged flow recess formed generally at the forward end of said seal surface, and further including second seal means carried by said outer flow control sleeve for axially sliding, substantially sealed engagement with said seal surface when said faceplate subassembly is in the first and second positions, said faceplate further defining a third nozzle outlet formed therein at a radial position outside said outer flow control sleeve;

said faceplate subassembly being axially movable with said selector ring as a unit relative to said nozzle housing subassembly between a first position with said inner seal means disposed rearward relative to said stem flow port to permit water flow between said stem and said inner flow control sleeve for discharge through said first nozzle outlet, a second position with said inner seal means disposed forward relative to said stem flow port to permit water flow outside said inner flow control sleeve for discharge through said second nozzle outlet, and a third position with said inner seal means disposed forward of the stem flow port and with the outer seal means disposed forward of said nozzle housing seal surface to permit water flow from said stem outlet port through said nozzle housing flow recess for discharge through said third nozzle outlet.

8. The multiple pattern spray nozzle of claim 7 wherein said second nozzle outlet is defined by a generally annular pattern of relatively small outlet openings formed in said faceplate generally in surrounding relation to said first nozzle outlet.

9. The multiple pattern spray nozzle of claim 7 wherein said inner seal means comprises a seal ring carried by said inner flow control sleeve.

10. The multiple pattern spray nozzle of claim 7 further including valve means coupled to said inlet fitting for controllably connecting and disconnecting said inlet fitting with the water supply.

11. The multiple pattern spray nozzle of claim 7 wherein said selector ring is threaded onto said nozzle housing for simultaneous rotational movement and axial displacement with respect to said nozzle housing.

12. The multiple pattern spray nozzle of claim 7 including stop means for preventing axial movement of said faceplate subassembly off said nozzle housing in a forward direction.

13. The multiple pattern spray nozzle of claim 7 wherein said faceplate subassembly and said nozzle housing subassembly include interengageable threads for threadably supporting said faceplate subassembly with respect to said nozzle housing subassembly, and further including stop means for preventing axial displacement of said faceplate subassembly off said nozzle housing subassembly in a forward direction, said stop means comprising a retainer ring carried by said faceplate subassembly and defining at least one stop surface set for substantial flush contact engagement with the threads on said nozzle housing subassembly.

14. The multiple pattern spray nozzle of claim 13 wherein said retainer ring is carried by said selector ring.

15. The multiple pattern spray nozzle of claim 14 wherein said retainer ring is releasably snap-fit engageable with said selector ring.

16. The multiple pattern spray nozzle of claim 13 wherein said interengageable threads comprise a multilead thread formed within said selector ring and a plurality of part-circle thread segments formed about said nozzle housing, said at least one stop surface comprising a plurality of said stop surfaces for engaging the ends of a plurality of said thread segments.

17. The multiple pattern spray nozzle of claim 7 wherein said stem unit further includes a swirl cap carried generally at the closed forward end of said stem, said swirl cap including a generally truncated conical hollow base connected to said stem and converging therefrom in a forward direction, said base defining a swirl chamber and at least one inlet port opening into said swirl chamber, said swirl cap further defining a relatively small bore nozzle outlet opening from said swirl chamber in a forward direction generally in alignment with said first nozzle outlet;

said inner flow control sleeve having a valve seat of reduced diametric size formed therein generally adjacent said faceplate for substantially seated engagement with said swirl cap base at a position generally forward from said inlet port, said valve seat being supported in spaced relation with said swirl cap base when said faceplate subassembly is in said first position;

said faceplate subassembly being movable to a fourth position with said valve seat in seated engagement with said swirl cap base and said seal means disposed rearward from said stem flow port to limit water flow to passage into said swirl chamber for discharge through the small bore nozzle outlet in said swirl cap.

18. The multiple pattern spray nozzle of claim 17 wherein said first nozzle outlet has a generally truncated conical shape diverging in a downstream direction, and wherein said swirl cap further includes a relatively small discharge barrel having said small bore nozzle outlet formed therein, said discharge barrel having an enlarged deflector ring formed thereabout, said first nozzle outlet being disposed relative to said deflector ring when said faceplate subassembly is in the first position for deflection of water generally along the truncated conical contour of said first nozzle outlet.

19. The multiple pattern spray nozzle of claim 18 wherein said faceplate subassembly further includes means forming a generally cylindrical jet nozzle outlet at an axial position generally between said valve seat and said first nozzle outlet, said faceplate subassembly being further movable to a fifth position with said jet nozzle outlet disposed in relatively close surrounding relation with respect to said deflector ring for water discharge therebetween as a relatively low profile jet spray.

20. The multiple pattern spray nozzle of claim 7 further including means for varying the spray pattern geometry of said first nozzle outlet, said spray pattern varying means being adjustably positionable by said selector means.

21. A multiple pattern spray nozzle for connection to a supply of water and adjustable to provide a plurality of different spray patterns, said spray nozzle comprising:

a generally cylindrical nozzle housing having an inlet fitting at a rearward end thereof for connection to the water supply, and a diametrically enlarged forward end portion defining a generally cylindrical inner diameter seal surface bordered on the forward end thereof by a radially enlarged, generally annular flow recess, said forward end portion further having external threads formed thereabout;

a generally cylindrical hollow stem having an open rearward end seated within said inlet fitting for receiving a flow of water from the water supply, said stem extending from said inlet fitting generally coaxially into said forward end portion of said nozzle housing in substantial spaced relation therewith and having a substantially closed forward end, said stem further having at least one radially open flow port formed near said forward end;

a swirl cap supported generally on the forward end of said stem and extending therefrom generally coaxially therewith in a forward direction, said swirl cap including a generally truncated conical hollow base supported on said stem and defining a swirl chamber and further defining at least one inlet port opening generally tangentially into said swirl chamber, said swirl cap further including a relatively small discharge barrel defining a small bore mist nozzle outlet extending from said swirl chamber in a forward direction, said discharge barrel having a radially enlarged deflector ring formed thereabout;

a generally annular selector ring having internal threads for threaded engagement with the external threads about said forward end portion of said nozzle housing, said selector ring being rotatably and axially movable relative to said nozzle housing;

a generally circular faceplate supported generally at the forward end of said selector ring for movement therewith and generally overlying the forward end of said nozzle housing, said faceplate having formed therein a soaker flow nozzle outlet defined by an outer annular array of relatively large soaker flow channels, a shower spray nozzle outlet defined by an inner annular array of relatively small shower spray openings, and a central conical nozzle outlet of generally truncated conical shape;

an inner flow control sleeve carried by said faceplate in surrounding relation with said conical nozzle outlet, said inner flow control sleeve extending into said nozzle housing in generally concentric spaced relation relative to said stem;

means forming a generally cylindrical jet nozzle outlet generally at the rearward end of said conical nozzle outlet;

means forming a valve seat carried by said first flow control sleeve at the rearward end of said jet nozzle outlet for substantially sealed engagement with said swirl cap base at a position forward relative to said inlet port therein;

first seal means carried by said inner flow control sleeve for substantially sealed, axially sliding engagement with said stem;

an outer flow control sleeve carried by said faceplate generally radially between said shower and soaker flow nozzle outlets, said outer flow control sleeve extending into said nozzle housing in radially spaced relation with said forward end portion thereof and with said inner flow control sleeve; and second seal means carried by said outer flow control sleeve for substantially sealed, axially sliding engagement with said seal surface;

said selector ring being rotatable about said nozzle housing to a first position with said valve seat seated upon said swirl cap base and with said first seal means engaging said stem rearward relative to said stem flow port and with said second seal means engaging said seal surface to permit water flow through said stem flow port between said inner flow control sleeve and said stem into said swirl chamber for discharge through said mist nozzle outlet as a substantially mist spray pattern;

said selector ring being rotatable about said nozzle housing to a second position with said valve seat spaced forward from said swirl cap base and with said first seal means in an rearward position relative to said stem flow port and said second seal means in engagement with said seal surface to permit water flow from said stem flow port through said jet nozzle outlet and further through said conical nozzle outlet, said deflector ring being disposed within said conical nozzle outlet to deflect the water flow into a generally conical spray pattern;

said selector ring being rotatable to a third position about said nozzle housing with said first seal means rearward relative to said stem outlet port and with said second seal means engaged with said seal surface and with said deflector ring disposed generally within said jet nozzle outlet in closed spaced relation therewith to permit water flow therethrough in a narrow profile jet spray pattern;

said selector ring being rotatable to a fourth position about said nozzle housing with said first seal means shifted to a forward position relative to said stem flow port and said second seal means engaged with said seal surface, said first seal means diverting water flow from said stem flow port to the exterior of said inner flow control sleeve for discharge through said shower spray nozzle outlet with a shower spray pattern geometry;

said selector ring being rotatable further to a fifth position about said nozzle housing with said first seal means in a forward position relative to said stem flow port and with said second seal means in a forward position relative to said seal surface to permit water flow additionally about said outer flow control sleeve through said flow recess for discharge through said soaker flow nozzle outlet with a generous low-force soaker flow spray pattern.

22. The multiple pattern spray nozzle of claim 21 wherein said first and second seal means comprise resilient seal rings.

23. The multiple pattern spray nozzle of claim 21 wherein said flow recess in said nozzle housing forward end portion is interrupted by a circumferentially spaced plurality of relatively short ribs.

24. The multiple pattern spray nozzle of claim 21 wherein said nozzle housing, said stem, and said swirl cap are preassembled to form a nozzle housing subassembly, and wherein said selector ring, said faceplate, said inner and outer flow control sleeves, said valve seat forming means, and said jet nozzle forming means are preassembled to form a faceplate subassembly.

25. The multiple pattern spray nozzle of claim 24 wherein said nozzle housing and faceplate subassemblies are formed from plastic.

26. The multiple pattern spray nozzle of claim 21 wherein said stem includes a plurality of radially open flow ports.

27. The multiple pattern spray nozzle of claim 21 wherein said swirl cap base includes a plurality of inlet ports opening generally tangentially into said swirl chamber.

28. The multiple pattern spray nozzle of claim 21 wherein said faceplate includes a faceplate wall having said shower spray nozzle outlet formed therein, said faceplate wall being convexly curved in a forward direction and said shower spray openings being centered individually on axes diverging relative to each other.

29. The multiple pattern spray nozzle of claim 21 wherein said inner flow control sleeve comprises a bushing mounted on said faceplate, and a cap ring mounted on said bushing at the upstream end thereof, said cap ring cooperating with said bushing to support and retain said first seal means.

30. The multiple pattern spray nozzle of claim 21 wherein said selector ring includes a plurality of upstanding outer, axially extending ribs for easy manual grasping.

31. The multiple pattern spray nozzle of claim 21 further including a retainer ring for releasably retaining said selector ring about said nozzle housing.

32. The multiple pattern spray nozzle of claim 31 wherein said selector ring and said retainer ring include interengageable snap-fit latch means.

33. The multiple pattern spray nozzle of claim 31 wherein said selector ring includes a plurality of upstanding axial ribs, at least some of which are separated by relatively short raised seats, said retainer ring including latch fingers for snap-fit engagement with said seats.

34. The multiple pattern spray nozzle of claim 33 wherein said retainer ring further includes a plurality of support fingers extending between a plurality of adjacent pairs of said ribs on said selector ring.

35. The multiple pattern spray nozzle of claim 31 wherein said retainer ring includes at least one stop surface for substantial flush contact engagement with said external thread on said nozzle housing when said selector ring is substantially in said fifth position.

36. The multiple pattern spray nozzle of claim 31 wherein said retainer ring includes indicia means for indicating the rotational position of said selector ring about said nozzle housing.

* * * * *